United States Patent [19]

Clemens

[11] Patent Number: 4,778,542

[45] Date of Patent: Oct. 18, 1988

[54] HIGH ENERGY BALL MILLING METHOD FOR MAKING RARE EARTH-TRANSITION METAL-BORON PERMANENT MAGNETS

[75] Inventor: Bruce M. Clemens, Washington, Mich.

[73] Assignee: General Motors Corporation, Detroit, Mich.

[21] Appl. No.: 885,943

[22] Filed: Jul. 15, 1986

[51] Int. Cl.[4] ..... H01F 1/02

[52] U.S. Cl. ..... 147/105

[58] Field of Search ..... 148/103, 105, 101; 419/12, 23; 241/23

[56] References Cited

U.S. PATENT DOCUMENTS 4,043,845 8/1977 Dionne ..... 148/105
4,135,953 1/1979 Nagel et al. ..... 148/105

FOREIGN PATENT DOCUMENTS 0124655 11/1984 European Pat. Off. .
60-91601 5/1985 Japan .

*Primary Examiner*—John P. Sheehan
*Attorney, Agent, or Firm*—Elizabeth F. Harasek

[57] ABSTRACT

Fully crystalline forms of rare earth-transition metal-boron compositions can be attrited under high-energy conditions (such as high energy ball milling) to product homogeneous alloy with crystals smaller than single magnetic domain size. Such alloy can be annealed or hot formed to produce permanent magnets with high magnetic energy products.

3 Claims, 2 Drawing Sheets

HIGH ENERGY BALL MILLING METHOD FOR MAKING RARE EARTH-TRANSITION METAL-BORON PERMANENT MAGNETS

This invention relates to high energy ball milling (HEBM) of rare earth-transition metal alloys, particularly neodymium-iron-boron alloys, to make permanent magnets with high coercivities and energy products.

BACKGROUND

Rare earth-iron (RE-Fe) based alloys can be magnetically hardened by quenching in a substantially amorphous to very finely crystalline microstructure. This is taught, for example, in U.S. Pat. No. 4,496,395 and U.S. Ser. Nos. 414,936 (filed Sept. 3, 1982) and 544,728 (filed Oct. 26, 1983) all to Croat and assigned to the assignee hereof. USSN No. 520,170 to Lee (filed Aug. 4, 1983) and assigned to the assignee hereof teaches how such alloys can be hot-worked to improve their magnetic properties.

Jet casting or melt-spinning is one method of creating such fine microstructures in RE-Fe based alloys. This method entails ejecting a molten stream of alloy through a small orifice onto a rapidly moving quench surface, such as the perimeter of rotating quench wheel. Such rapid cooling creates a very fine ribbon of material in which the crystals of the principal phase have diameters in the range of from about 20–800 nanometers. In RE-Fe-B magnets, this phase has the nominal composition $RE_2Fe_{14}B_1$. The phase forms for all rare earths and substantial amounts of other transition metals, such as cobalt, can be substituted for Fe.

While jet casting has proven to be an acceptable way of quenching in a desired microstructure in rare earth-iron boron alloys, it would be desirable to arrive at the same result without the inherent problems of jet casting, particularly the problems associated with handling molten rare earth containing alloys.

BRIEF SUMMARY

In accordance with the preferred practice of this invention, constituent rare earth metal(s), transition metal element(s), and boron are added to a high energy ball mill in suitable proportions. The constituents may be in elemental or alloyed form or a mixture of both. The constituents are ball milled together under highly energetic conditions. This causes the particles within the mill to repeatedly fracture, weld and reweld. Ultimately, high energy ball milling creates fully compositionally uniform (homogeneous) alloy particles in which the crystal size of the major phase is much smaller than the single domain size of about 400 nanometers.

These materials can be annealed or hot worked at an elevated temperature such that crystal growth takes place resulting in a high energy product comparable to that of overquenched and annealed jet cast alloy.

DETAILED DESCRIPTION

My invention will be better understood in view of the several figures and detailed description which follow.

Figure 1:
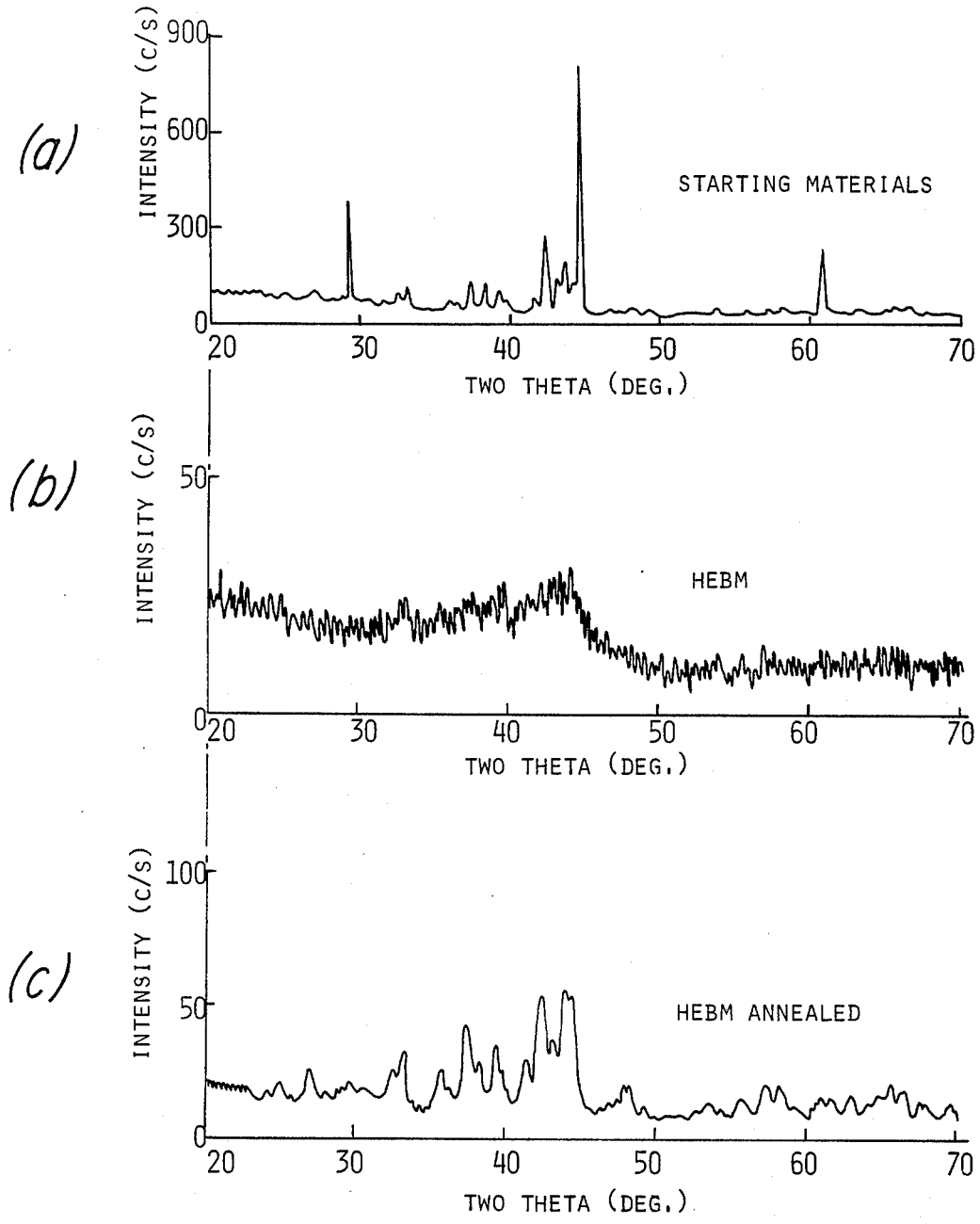
FIGS. 1 (*a*)(*b*) and (*c*) are an X-ray diffraction pattern for an underquenched sample of jet cast neodymium iron-boron alloy ribbon; the same ribbon after high energy ball milling; and the ball milled sample after annealing at 600° C.

My method is applicable to compositions comprising a suitable transition metal component, a suitable rare earth component, and boron.

The transition metal component is iron or iron and (one or more of) cobalt, nickel, chromium or manganese. Cobalt is interchangeable with iron up to about 40 atomic percent. Chromium, manganese and nickel are interchangeable in lower amounts, preferably less than about 10 atomic percent. Zirconium and/or titanium in small amounts (up to about 2 atomic percent of the iron) can be substituted for iron. Very small amounts of carbon and silicon can be tolerated where low carbon steel is the source of iron for the composition. The composition preferably comprises about 50 atomic percent to about 90 atomic percent transition metal component—largely iron.

The composition also comprises from about 10 atomic percent to about 50 atomic percent rare earth component. Neodymium and/or praseodymium are the essential rare earth constituents. As indicated, they may be used interchangeably. Other rare earth elements, such as samarium, lanthanum, cerium, terbium and dysprosium, may be mixed with neodymium and praseodymium without substantial loss of the desirable magnetic properties. Preferably, they make up no more than about 40 atomic percent of the rare earth component. It is expected that there will be small amounts of impurity elements with the rare earth component.

The compositions preferably contain about 1 to 10 atomic percent boron.

The preferred compositions may be expressed by the formula $RE_{1-x}(TM_{1-y}B_y)_x$. The rare earth (RE) component makes up 10 to 50 atomic percent of the composition ($x=0.5$ to 0.9), with at least 60 atomic percent of the rare earth component being neodymium and/or praseodymium. The transition metal (TM) as used herein makes up about 50 to 90 atomic percent of the overall composition, with iron preferably representing at least about 60 atomic percent of the transition metal content. The other constituents, such as cobalt, nickel, chromium or manganese, are called "transition metals" insofar as the above empirical formula is concerned. The substitution of cobalt for iron tends to increase Curie temperature. Boron is preferably present in an amount of about 1 to 10 atomic percent ($y=$about 0.01 to 0.11) of the total composition.

For convenience, the compositions have been expressed in terms of atomic proportions. Obviously these specifications can be readily converted to weight proportions for preparing the composition mixtures.

For purposes of illustration, my invention will be described in the Examples using compositions of approximately the following atomic proportions:

$$Nd_{0.14}(Fe_{0.94}B_{0.06})_{0.86}$$

However, it is to be understood that my method is applicable to a family of compositions as described above. All HEBM was conducted in a glove box having an argon atmosphere. All magnetic measurements were made on a Princeton Applied Research magnetometer with a 19 kOe demagnetizing field. The samples were first magnetized in a 40kOe pulsed field.

EXAMPLE 1

5 grams of underquenched, jet cast Nd-Fe-B ribbons of were placed in a SPEX Model 8000 ball mill. The ball mill container was approximately 1.5 inches in diameter by 2.25 inches long. Four balls, 0.25 inch in diameter, and two balls, 0.50 inch in diameter, were placed within the mill. The grinding chamber was positioned and sealed with an O-ring. Both the grinding balls and the ball mill container were made of 304 stainless steel. The ball mill was rotated at 17 Herz for two hours at room temperature (about 23° C.). Milling caused the container temperature to rise to a maximum of about 40° C.

The milled ribbon was powdery with an average particle size of about $5\times10^{-6}$. The powder was removed from the ball mill, annealed in a differential scanning calorimeter (DSC) at a ramp rate of 50° C. per minute to a maximum temperature of about 600° C. and cooled at ambient temperature in the glove box. An exotherm at 500° C. demonstrated crystallization of the HEBM sample.

FIG. 1(*a*) shows a copper k-alpha X-ray diffraction pattern for the underquenched ribbons before HEBM. The sharp peaks are representative of crystalline, underquenched ribbons whose grain size is so large that high energy products (>than about 5 MGOe) cannot be obtained at magnetic saturation. The principal phase of the alloy is $Nd_2Fe_{14}B_1$ as evidenced by the diffraction pattern for the underquenched ribbon having major peaks indexed at 42.3, 37.3, 44.1, 39.2 and 33.0 20 degrees. Since most of the grains are already larger than single magnetic domain size, annealing does not improve permanent magnetic properties.

FIG. 1(*b*) shows an X-ray pattern for the sample immediately after high energy ball milling. No sharp peaks are apparent, corresponding to a crystal size in the HEBM sample estimated to be about 4 nanometers based on peak widths. This grain size is substantially smaller than single domain size.

FIG. 1(*c*) shows an X-ray pattern of the sample after annealing and confirms the presence of the $Nd_2Fe_{14}B_1$ phase and fine-grained microstructure.

Figure 2:
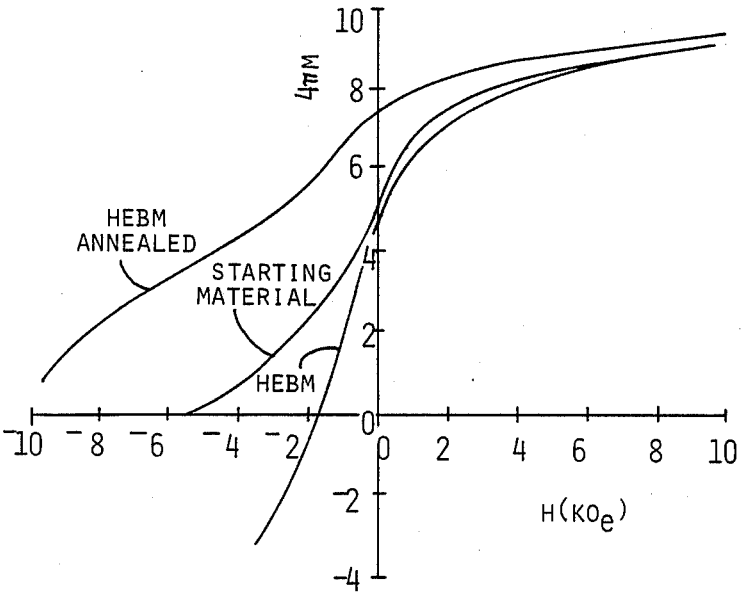
FIG. 2 shows second quadrant hysteresis plots for the sample of FIG. 1.

FIG. 2 shows second quadrant hysteresis curves for the starting underquenched ribbon, for the sample after HEBM and for the HEBM sample after annealing. The low coercivity and small energy product (2.4 MGOe) of the starting material is typical of underquenched, jet cast ribbon. No increase in the magnetic properties of this underquenched sample was observed after annealing at 600° C.

The sample has even lower coercivity after high energy ball milling and an energy product of only 1.5 MGOe. These magnetic properties are typical of an overquenched jet cast alloy or one having an amorphous or very finely microcrystalline structure in which the grains (crystals) are smaller than optimum single magnetic grain size.

The annealed HEBM material had the largest coercivity and an energy product of approximately 7 megaGausOersted. This indicates that annealing the high energy ball milled material with very fine microstructures creates grain growth and resultant increase in permanent magnetic properties.

EXAMPLE 2

A 5 gram sample of $Nd_{0.14}Fe_{0.94}B_{0.06}$(0.86) was attrited in the HEBM as set forth in Example 1 for six hours. The sample was placed in a cylindrical die cavity ⅜ inch in diameter having movable top and bottom punches. The die and its contents were rapidly heated under argon with an induction heating coil to a maximum temperature of about 725° C. The upper punch was then activated and the pressure was ramped to a maximum of 15,000 psi in less than a second. The total time at maximum temperature for the sample was about 2.25 minutes. Heating and pressure were stopped and the workpiece was allowed to cool to room temperature on the die.

Figure 3:
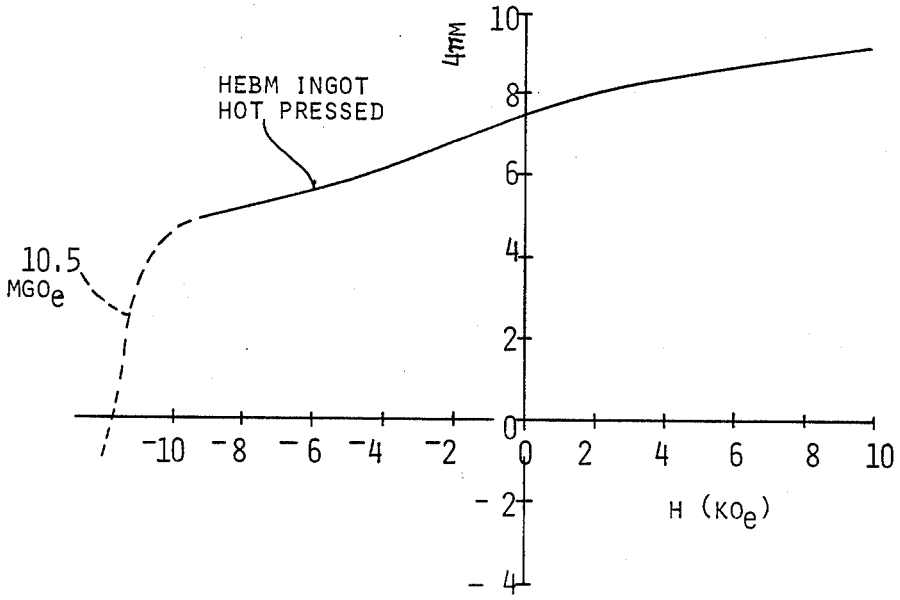
FIG. 3 shows second quadrant hysteresis plots for a sample of $Nd_{0.14}(Fe_{0.94}B_{0.06})_{0.86}$ ingot which was high energy ball milled and hot pressed.

FIG. 3 shows the second quadrant demagnetization curve for the hot pressed compact. The end of the curve is extrapolated (hashed line) because the reverse field in the magnetometer was not functioning properly beyond about 10 MGOe. The hot pressed HEBM compact had a magnetic energy of approximately 10.5 megaGausOersted, which is comparable to hot-pressed overquenched melt-spun ribbon. I believe that hot working HEBM powder as taught in USSN No. 520,170 would result in even higher energy products.

In summary, I have discovered that fully crystalline forms of RE-Fe-B based compositions which cannot be magnetized directly (or annealed and magnetized) to form high energy permanent magnets can be processed by high energy ball milling to create alloys that have very fine grained microstructures. Such HEBM alloys can be annealed to obtain crystallographic and magnetic properties comparable to those of direct quenched or overquenched and annealed melt-spun ribbons. HEBM alloys can also be hot worked to provide fully densified compacts with high energy products. While HEBM is the preferred method of processing magnetic RE-Fe-B alloys, other mechanical alloying/attriting methods which also create very finely grained microstructures would also be suitable.

While my invention has been described in terms of specific embodiments thereof, other forms may be readily adapted by one skilled in the art. Accordingly, the scope of my invention is to be limited only in accordance with the following claims.

The embodiments of the invention in which an exclusive property or privilege is claimed are defined as follows:

1. A method of making a rare earth-transition metal-boron (RE-TM-B) based permanent magnet which comprises about 50 to about 90 atomic percent transition metal at least about 60 percent of which is iron, about 10 to about 50 atomic percent rare earth metal including at least about 6 atomic percent Nd and/or Pr and from about 0.5 to about 10 atomic percent B, the method comprising high energy ball milling suitable proportions of the constituent elements to form a homogeneous alloy in which the principal phase is $RE_2TM_{14}B_1$ and the grains in which phase have an average crystal size substantially less than about 400 nanometers; and heating said alloy to a temperature such that said crystals grow and the alloy has a coercivity at magnetic saturation greater than about 5000 Oersteds.

2. A method of treating a crystalline, rare earth-transition metal-boron (RE-TM-B) alloy which comprises about 50 to about 90 atomic percent transition metal at least about 60 percent of which is iron, about 10 to about 50 atomic percent rare earth metal including at least about 6 atomic percent Nd and/or Pr and from about 0.5 to about 10 atomic percent B and in which the principal phase is $RE_2TM_{14}B_1$ to make a permanent magnet, which alloy has an energy product less than about 5 MGOe at magnetic saturation and in which an energy product greater than about 5 MGOe at magnetic saturation cannot be induced by further grain growth, said method comprising high energy ball milling said alloy for a time such that a principal $RE_2TM_{14}B_1$ phase is present with an average grain size smaller than about 400 nanometers.

3. A method of treating a mixture of crystalline constituents taken from the group constituents taken from the group consisting of rare earth metals (RE), transition metals (TM), boron (B) or alloys thereof which mixture has an energy product less than about 5 MGOe at magnetic saturation and in which an energy product greater than about 5 MGOe at magnetic saturation cannot be induced by further grain growth, which constituents are combined in proportions comprising about 50 to about 90 atomic percent transition metal at least about 60 percent of which is iron, about 10 to about 50 atomic percent rare earth metal including at least about 6 atomic percent Nd and/or Pr and from about 0.5 to about 10 atomic percent B, and which are subjected to high energy ball milling to produce an alloy in which the principal phase is $RE_2TM_{14}B_1$ and the crystals of the principal phase are substantially smaller than 400 nanometers and thereafter heating said composition grow said crystals such that it obtains a coercivity at magnetic saturation greater than about 5000 Oersteds.

* * * * *